US006463986B1

(12) United States Patent
Gouda

(10) Patent No.: US 6,463,986 B1
(45) Date of Patent: Oct. 15, 2002

(54) WINDOW TREATMENT ASSEMBLY PULL-CORD KEEPER

(76) Inventor: William C. Gouda, 12 Van Kirk Rd., Princeton, NJ (US) 08540

( * ) Notice: Subject to any disclaimer, the term of this patent is extended or adjusted under 35 U.S.C. 154(b) by 0 days.

(21) Appl. No.: 09/829,639

(22) Filed: Apr. 10, 2001

(51) Int. Cl.[7] ..... E06B 9/30

(52) U.S. Cl. ..... 160/178.1 R; 242/376

(58) Field of Search ..... 160/178.1 R, 173 R, 160/177 R, 170 R, 168.1 R, 172 R, 320, 321; 242/371, 378, 378.1, 388, 388.1, 385.1, 385.2, 385.4

(56) References Cited

U.S. PATENT DOCUMENTS

| | | | | |
|---|---|---|---|---|
| 1,446,410 A | | 2/1923 | Bennett et al. | |
| 2,187,458 A | * | 1/1940 | Lawson | 160/178.1 R |
| 3,123,130 A | * | 3/1964 | Fridlund | 160/168.1 R |
| 3,465,806 A | * | 9/1969 | Sulkes | 160/84.06 |
| 4,271,893 A | | 6/1981 | McCluskey | 160/178 |
| 4,443,944 A | | 4/1984 | Beesley | 33/138 |
| 4,543,806 A | | 10/1985 | Papandrea et al. | 70/30 |
| 5,279,473 A | | 1/1994 | Rozon | 242/107.12 |
| 5,354,011 A | | 10/1994 | Rozon | 242/402 |
| 5,553,650 A | | 9/1996 | Jelic | 160/178.1 |
| 5,630,456 A | | 5/1997 | Hugo et al. | 160/173 |
| 5,699,975 A | | 12/1997 | Paugh et al. | 242/371 |
| 5,762,281 A | * | 6/1998 | Foley | 160/178.1 R X |
| 5,791,580 A | | 8/1998 | Anderson et al. | 242/378.4 |
| 5,918,658 A | | 7/1999 | Schartner | 160/178.1 |

* cited by examiner

*Primary Examiner*—David M. Purol
(74) *Attorney, Agent, or Firm*—Watov & Kipnes, P.C.; Kenneth Watov

(57) ABSTRACT

A pull-cord keeper is provided for a window treatment assembly with a pull-cord for operation. The pull-cord keeper includes a wall-mountable housing adapted for permanently mounting to the wall at a desired height above the floor, the housing further including a cavity defined therein and an opening in communication with the cavity, and at least one fastener for securely mounting the housing to the wall. The pull-cord keeper further includes a spool adapted for rotational movement within the cavity to reel and collect through the opening a length of the pull-cord, and a spring for biasing the spool in a rotational direction for automatically and continuously collecting any loose length of the pull-cord.

10 Claims, 7 Drawing Sheets

WINDOW TREATMENT ASSEMBLY PULL-CORD KEEPER

FIELD OF THE INVENTION

The present invention relates generally to cord keepers, and more particularly to cord keepers adapted for window treatment assemblies to take up loose cords, chains, strings, and the like, in order to protect infants and young children from potentially lethal suffocation and entanglement hazards.

BACKGROUND OF THE INVENTION

Pull-cords are utilized in various types of window treatment assemblies for operating and manipulating such window treatment assemblies such as adjusting the level of the window coverings, for example. Typically, the pull-cord consists of a single or multiple strands of threads that are typically tied together or looped. A locking device is usually provided for clamping the cords to hold the window covering at whatever height the user desires by operation of the pull-cords. The pull-cord usually extends from a head rail portion of the window treatment assembly to within a few inches or less from floor level. Such tied or looped pull-cords extending from the window treatment assembly, often presents an attractive danger to infants or young children fascinated with pull-cords. Tragically, many infants and young children playing with such pull-cords, become entangled in the pull-cords resulting in some form of injury, and even death when accidentally hanged by the pull-cords.

For the foregoing reasons, there is a need for a cord keeper which can effectively prevent or minimize such accidents involving infants and young children in a simple and cost effective manner. In addition, it would be desirable to design a cord keeper that is inexpensive and easy to fabricate and use, and has a minimum number of parts while possessing the durability, reliability and strength required to withstand the stress and forces often experienced during operation of window treatment assembly pull-cords. Furthermore, there is a need for a cord keeper that is especially fail-safe, and which does not require separate actions by the user. Such a cord keeper must operate efficiently, yet be aesthetically pleasing and unobtrusive.

SUMMARY OF THE INVENTION

The present invention is generally directed to a window treatment assembly pull-cord keeper comprised of minimal component parts cooperating to form a device mountable on the surface of a wall or window casing, and adapted for continuously collecting or releasing a length of a pull-cord from a window treatment assembly for keeping the pull-cord taut each time the window treatment assembly is adjusted or operated. The pull-keeper of the present invention generally comprises a wall-mountable housing, a cord collecting assembly adapted for collecting a length of a flexible cord, and biased by spring means located within the housing, that has an opening for permitting the flexible cord to pass therethrough into the cord collecting assembly.

The window treatment assembly typically includes window covering material or blind slats extending between a head rail and bottom rail, and two or more lift cords connected to the bottom rail. Within the head rail, there is a cord locking device located therein. Typically, two or more lift cords are connected at one end of the bottom rail, and extend up through the window covering material or blind slats into the head rail. The lift cords then pass through a cord locking device and out of the head rail in a manner where the opposite end of the lift cords, or pull-cord, is accessible to a user. The window shades or blinds are typically raised by the user pulling on the accessible portion of the lift cords, or pull-cord, and are lowered by releasing the pull-cord. In this manner, the pull-cord can extend downward from the head rail to within a few feet from floor level.

The window treatment assembly pull-cord keeper of the present invention is adapted to be mounted in a manner for keeping the pull-cord out of reach of infants and small children who are typically attracted to the pull-cord, and who are most susceptible to becoming dangerously entangled in the pull-cord. The pull-cord keeper of the present invention operates by collecting the freely suspended length of the pull-cord of the window treatment assembly, and keeping the ends of the pull-cord away from persons of relatively shorter stature, particularly infants and young children. More specifically, the housing of the pull-cord keeper is adapted for secure mounting on the surface of the wall or window casing near the head rail, and the cord collecting assembly located in the housing, draws or releases the pull-cord through the housing opening according to the degree of slackness in the pull-cord. The cord collecting assembly is conveniently driven by spring means in a constant spring loaded state. The user can raise or lower the bottom rail as desired while the pull-cord keeper simultaneously draws or releases, respectively, a length of the pull-cord while keeping the pull-cord taut and away from the lower end of the window treatment assembly in a safe, efficient and effective manner. When the user is satisfied with the level of the bottom rail (e.g. of a Venetian blind), the cord locking device in the head rail is engaged as usual, and the pull-cord keeper automatically maintains the taut condition in the pull-cord. No separate action on the part of the user is required for operation.

In particular, one aspect of the present invention is directed to a pull-cord keeper for a window treatment assembly, which comprises:

- a wall-mountable housing;
- a cord collecting assembly located within the housing and adapted for collecting a loose length of a flexible cord;
- a spring adapted for rotating the cord collecting assembly to collect the loose length of the flexible cord; and
- an opening for permitting the flexible cord to pass therethrough into the housing to the cord collecting assembly.

In another aspect of the present invention, the pull-cord keeper comprises:

- a housing configured for secure mounting attachment on a wall near an upper portion of the window treatment assembly, said housing further defining a cavity therein;
- an opening in communication with said cavity;
- a spool adapted for rotational movement within said cavity to reel and collect through said opening a length of a slender flexible material; and
- spring bias for biasing the spool in a rotational direction for reeling in any loose length of the slender flexible material during a constant spring loaded state.

BRIEF DESCRIPTION OF THE DRAWINGS

Various embodiments of the invention are described in detail below with reference to the drawings, in which like items are identified by the same reference designation, wherein.

DETAILED DESCRIPTION OF THE INVENTION

Figure 1:
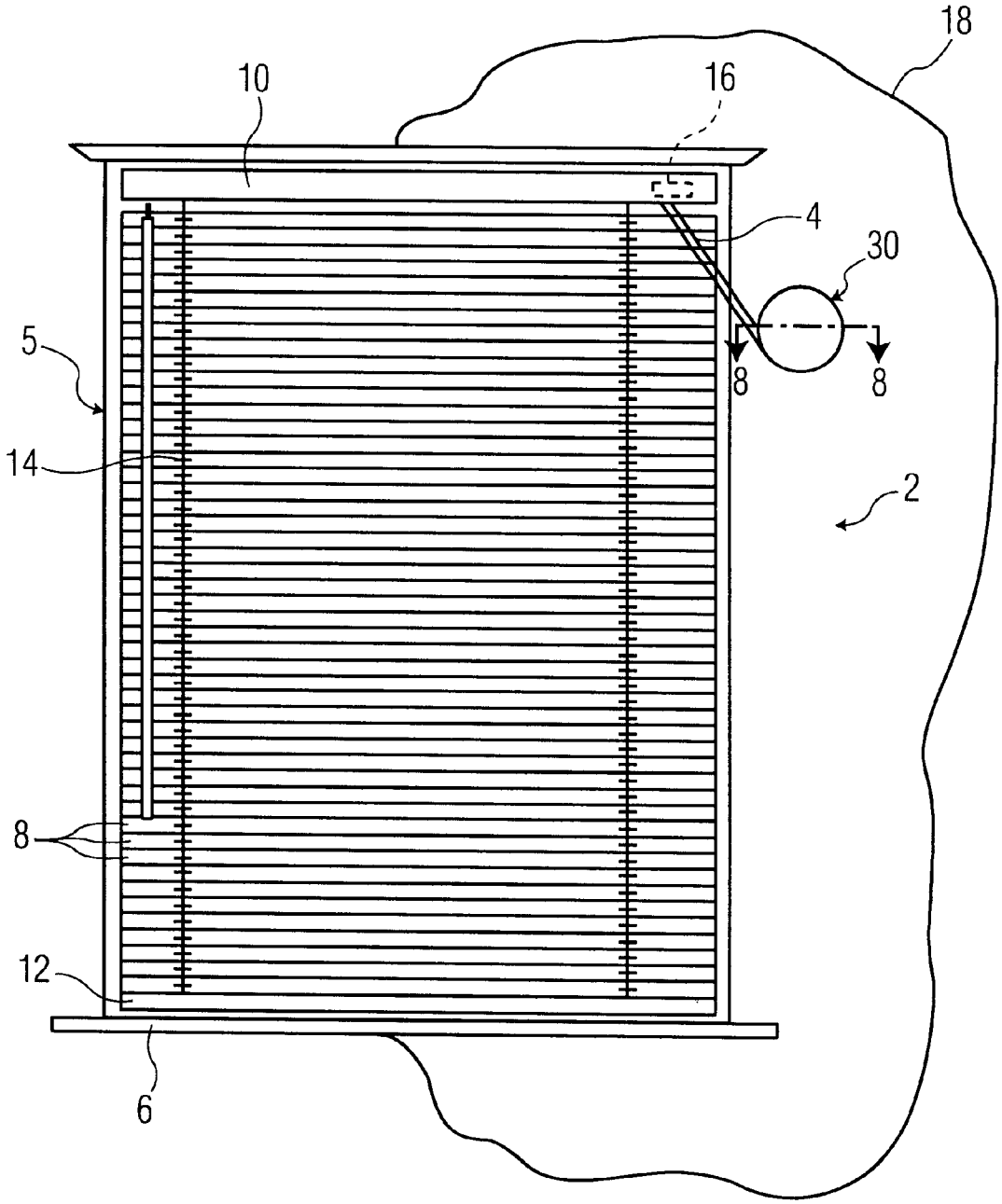
FIG. 1 is a front elevational view of a typical window treatment assembly with a pull-cord keeper of the present invention illustrated in use.

The present invention can be used with any type of window treatment assembly including Venetian blinds, pleated shades, Roman shades, and the like, where a pull-cord is utilized for normal operation. Although one embodiment of the present invention is shown and described in use with Venetian blinds, the invention is not so limited. As an example of the window treatment assembly having a pull-cord which forms a loop is shown in FIG. 1. The window treatment assembly may be a pleated shade, Roman shade, or Venetian blind. When the window covering is in an open position, the pull-cord can typically extend below the window sill to within a few inches from floor level where it can be reached easily by infants and young children.

The window treatment assembly 2 of FIG. 1 is shown in a closed position above a window sill 6 of a window 5. The window treatment assembly 2, in the form of a Venetian blind, typically includes a window covering material or blind slats 8 extending between a head rail 10 and bottom rail 12, and two or more lift cords 14 connected to the bottom rail 12. The head rail 10 is mounted on a top frame 7 of the window 5. A cord locking device 16 is located within the head rail 10. Typically, the two or more lift cords 14 are connected at one end of the bottom rail 12, and extend up through the window covering material or blind slats 8 into the head rail 10. The lift cords 14 then pass through the cord locking device 16 and out of the head rail 10 in a manner where the opposite end of the lift cords, or pull-cord 4, is accessible to a user. The window shades or blind slats 8 are typically raised by disengaging the cord locking device 16 and pulling the pull-cord 4, or lowered by releasing the pull-cord 4. When the user is satisfied with the level of the blind slats 8, the cord locking device 16 is re-engaged to fix the pull-cord 4 in place.

As further shown in FIG. 1, one embodiment of a pull-cord keeper 30 of the present invention is shown in use. The pull-cord keeper 30 is attached to the pull-cord 4 and permanently and securely mounted on a wall portion 18 near the head rail 10 of the window treatment assembly 2. The pull-cord keeper 30 may be mounted on the window casing portion of the window 5 for a more secure structural footing. During use, the pull-cord 4 is kept safely beyond the reach of infants and young children while being easily accessible to operators of the window treatment assembly 2. Also, the pull-cord keeper 30 advantageously does not require any separate actions on the part of the user, nor interfere with the normal operation of the window treatment assembly 2. The user simply operates the window treatment assembly 2 in the normal manner as described above. This self-operating ability enhances the fail-safety of the pull-cord keeper of the present invention.

Figure 2:
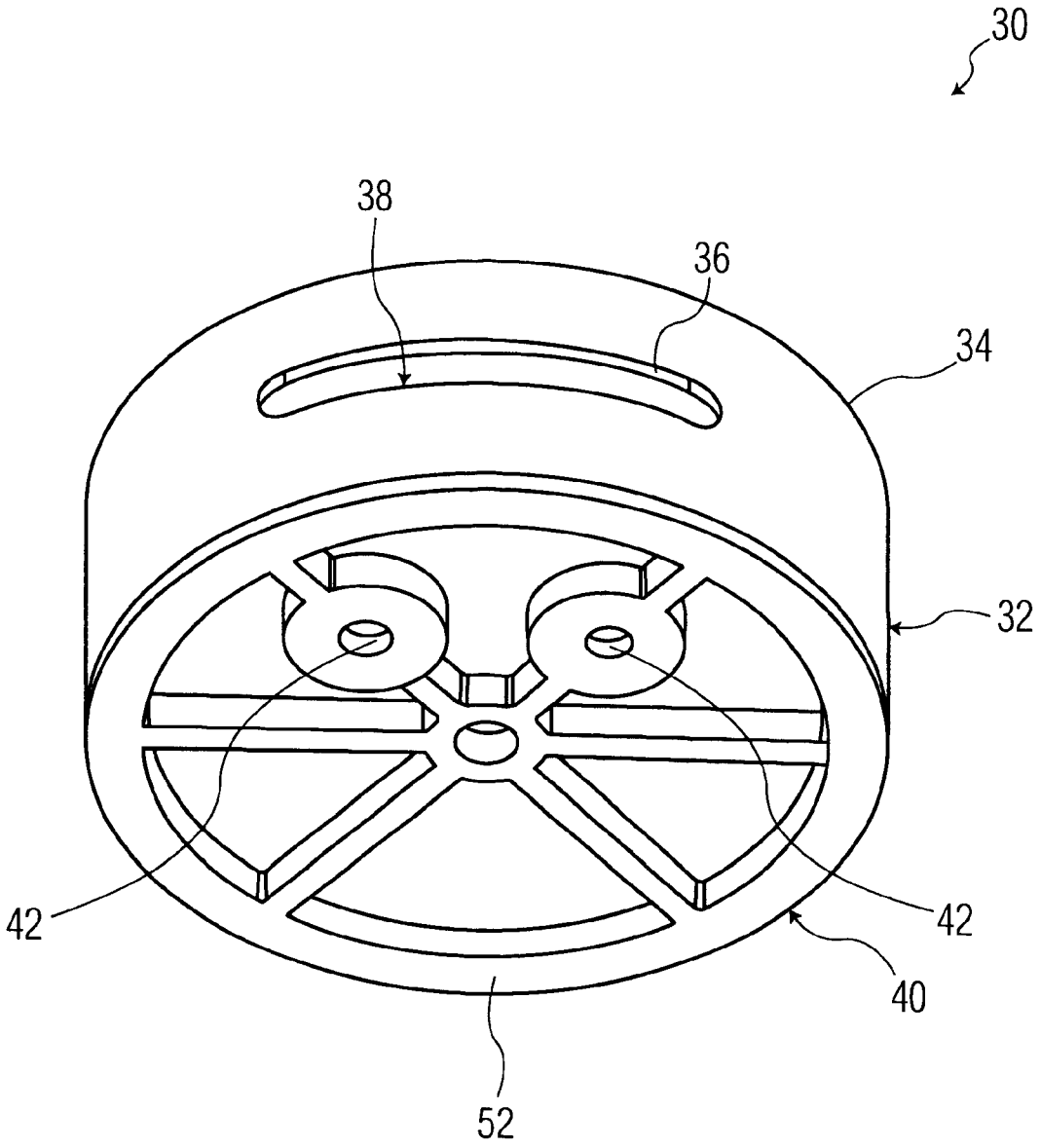
FIG. 2 is a front perspective view looking toward the bottom of a pull-cord keeper constructed in accordance with the teachings of the present invention.

Referring to FIG. 2, the pull-cord keeper 30 is shown set apart from the wall portion 18, looking toward the bottom and front portions. The pull-cord keeper 30 includes a cylindrical housing 32 which is adapted for securely mounting on a flat surface area of a wall or a portion of the window casing. The housing 32 comprises a cover or cap member 34 with an opening 36 in communication with an interior cavity 38 defined therein, and a mounting plate 40 with two mounting holes 42 for screw fasteners (not shown). The housing 32 is mounted to the wall 18 on a mounting surface 52 of the plate 40 which is shown hogged out for purposes of saving material and weight. The opening 38 is adapted to receive a free end of the pull-cord 4 and provides the pull-cord 4 access into the cavity 38. During use, the pull-cord keeper 30 retracts or releases the pull-cord 4, through the opening 38 after appropriate adjustment of the window treatment assembly 2. The opening 38 is elongate in shape and extends circumferentially along a portion of the side of the cover 34.

Figure 3:
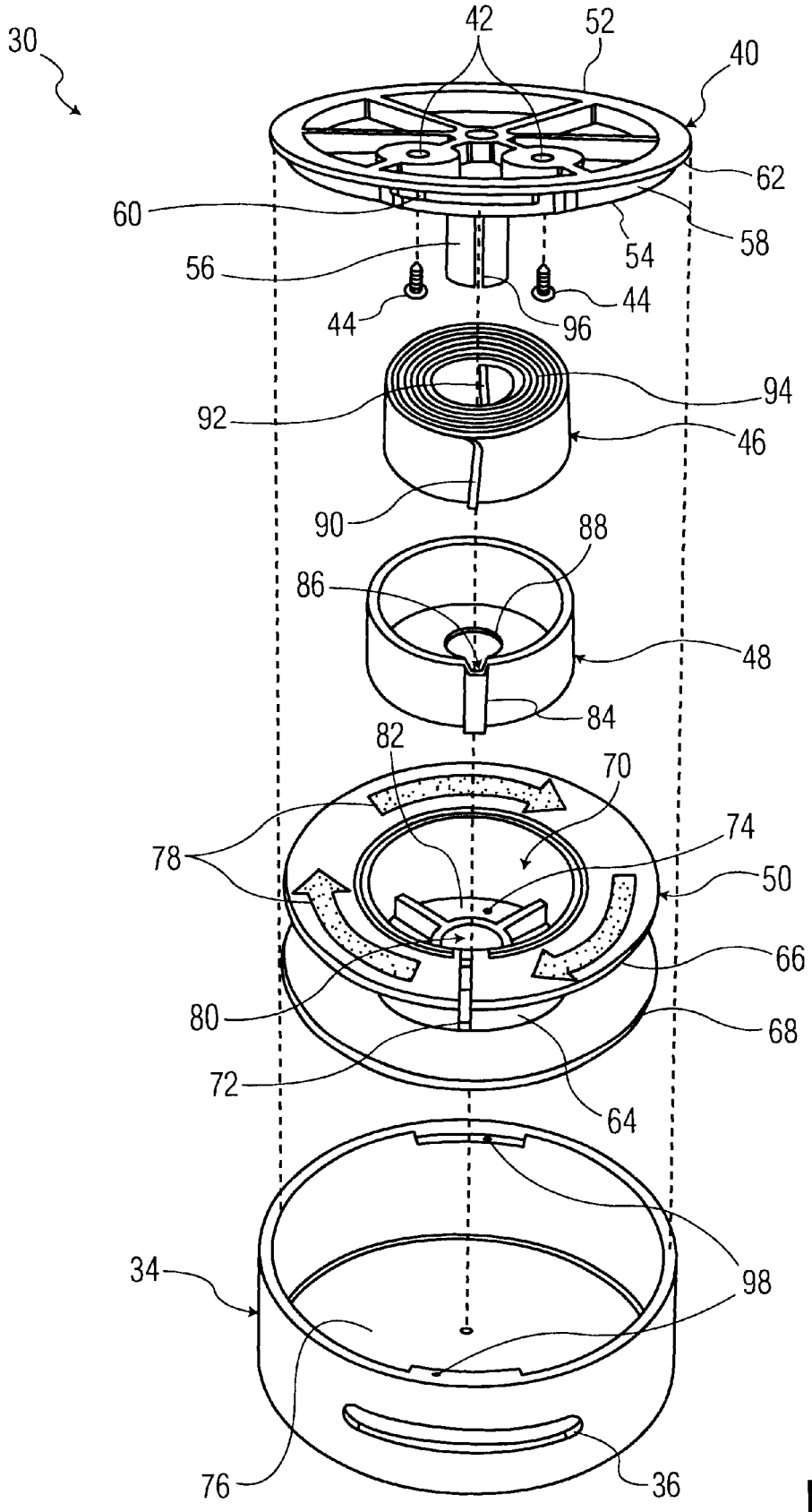
FIG. 3 is an exploded assembly view of the pull-cord keeper showing the component parts for one embodiment of the present invention.

With reference to FIG. 3, the pull-cord keeper 30 is shown in an exploded assembly view for illustrating all of the component parts and the arrangement of such parts therein. The pull-cord keeper 30 generally includes the mounting plate 40, a pair of screw fasteners 44, a coil spring 46, a spring cartridge 48, a spool member 50, and the cap member 34. The coil spring 46 fits into the spring cartridge 48. The spring cartridge 48, in turn, fits into a central cavity of the spool 50. The resulting assembly is enclosed within the cap member 34, with the mounting plate 40 being secured to the open end of the cap member 34.

The mounting plate 40 includes the mounting surface 52 on one side and a bearing surface 54 on an opposed interior side. In this embodiment, the mounting surface 52 is shown hogged out for reducing material usage and weight. The mounting surface 52 of the plate 40 is fastened to the wall 18 by the screw fasteners 44. The screw fasteners 44 are inserted through the screw holes 42 from the bearing side 54 into the wall 18. The mounting plate 40 further includes a centrally-located spindle body 56 extending perpendicularly from the bearing surface 54, a stepped portion 58 with a pair of opposed ramped projected recesses 60 formed circumferentially thereon, and a base flange 62 extending along the periphery thereof. The spindle body 56 supports the spool 50 for rotational movement therearound and is further configured for anchoring one end of the coil spring 46 during spring loading as will be described.

The spool member 50 includes a cylindrical body 64 with first and second flanges 66 and 68, respectively, and an axial bore 70 therebetween, a slot 72 extending radially through the first flange 66 and longitudinally through the side of the cylindrical body 64, and a base portion 74 at the lower end of the axial bore 70. The spool member 50 is free to rotate in a first direction on a bearing surface 76 of the cap member 34 for reeling a length of the pull-cord 4, and the rotation thereof in this direction being biased by the action of the coil spring 46. When the length of the pull-cord 4 is drawn from the keeper 30, the spool member 50 rotates in the opposite direction being resisted by the action of the coil spring 46 for rotationally biasing the spool member 50 in the first direction, thus loading the spring 46 with each turn. The top surface of the first flange 66 of the spool member 50 includes a set of friction contact strips 78 formed thereon as will be described.

The slot 72 of the spool 50 allows the free end of the pull-cord 4 to be inserted into the axial bore 70. The free end is preferably knotted to prevent the free end from slipping through the slot 72. The remaining length of the pull-cord 4 is wound around the cylindrical body 64 and captively retained between the flanges 66 and 68.

The base portion 74 and the axial bore 70 of the spool 50 forms a seat for the spring cartridge 48. The base portion 74 further includes a centrally-located aperture 80 and a raised cupola 82 extending around the aperture 80. The cupola 82 forms a hollow (not shown) for accommodating the free end of the pull-cord 4 occupying the axial bore 70 and supports the bottom of the cartridge 48 seated in the axial bore 70.

Figure 7:
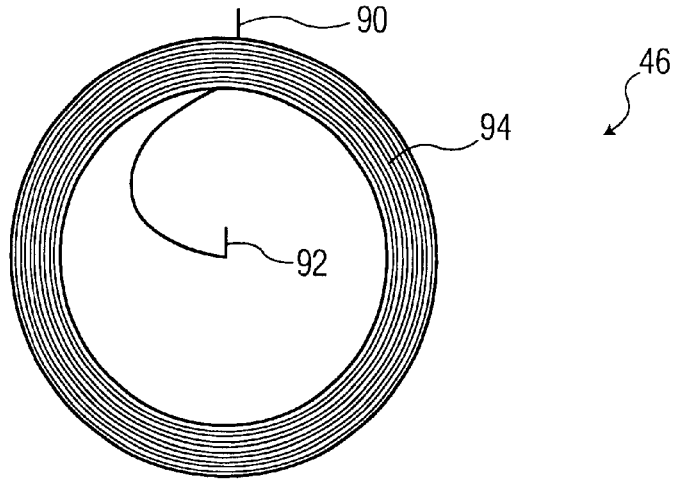
FIG. 7 is a top plan view of a coil spring forming part of the pull-cord keeper for one embodiment of the present invention.

The spring cartridge 48 includes a ridge 84 extending longitudinally along the exterior side thereof, a notch 86 in the interior side thereof coinciding with the exterior ridge 84, and a centrally-located hole 88. The cartridge 48 is configured to receive and retain therein the coil spring 46. As shown in FIG. 7, the coil spring 46 includes an external tang 90, an internal tang 92, and a coiled body 94. The external tang 90 is adapted to be inserted and retained in the notch 86 of the cartridge 48 as shown in FIG. 3. With the spring cartridge 48 seated within the axial bore 70 of the spool member 50, the ridge 84 is inserted and retained in the spool slot 72 with the bottom of the cartridge 48 resting on the raised cupola 82 above the knotted free end of the pull-cord 4.

The assembled spool member 50, cartridge 48, and coil spring 46 are then placed into the cap member 34. The cap member 34 is then mounted on the mounting plate 40 where the spindle body 56 is inserted through the center of the coil spring 46, the cartridge hole 88, and the spool bore 70 and aperture 80. The spindle body 56 includes a slot 96 formed by two or more bosses 102 for receiving and retaining the interior tang 92 of the coil spring 46. The cap member 34 further includes a pair of opposed ramped projection tabs 98 which cooperate with the pair of ramped projected recesses 60 adapted for secure locking engagement. The cap member 34 is slipped over the mounting plate 40 where the edge portion of the cap member 34 contacts the top surface of the mounting plate flange 62 and the sides of the stepped portion 58. For locking of the cap member 34 to the mounting plate 40, the projected recesses 60 and the projection tabs 98 are positioned adjacent to each other. Then, the cap member 34 is rotated in either direction on the mounting plate 40 until the tabs 98 snaps into the projected recesses 60. The cap member 34 may be removed from the mounting plate 40 by further rotating the cap member 34 until tabs 98 disengage the projected recesses 60. It is noted that the opening 36 of the cap member 34 in the locked position, should be directed towards the window treatment assembly 2 for efficient operation.

The cap member 34, the mounting plate 40, the spring cartridge 48, and the spool 50 of the pull-cord keeper of the present invention consist of any durable and rigid material including, but not limited to, plastic materials such as polyamide, nylon, polyethylene, polychloropene, polyvinyl chloride, polyester, polypropylene, polystyrene, polytetrafluoroethene, and polyurethane, and the like. More preferably, the material consists of thermosetting plastics, for example, resins, melamine, polyester, Bakelite®, and the like. The coil spring 46 consists of an elastic, resilient material including, but not limited to, metals.

Figure 4A:
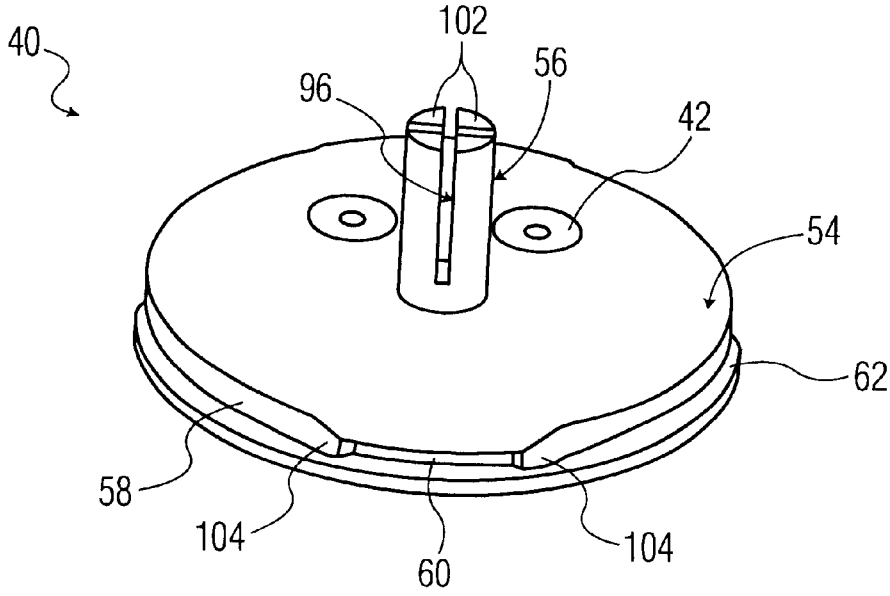
FIG. 4A is a perspective view of a mounting plate forming part of the pull-cord keeper for one embodiment of the present invention.
Figure 4B:
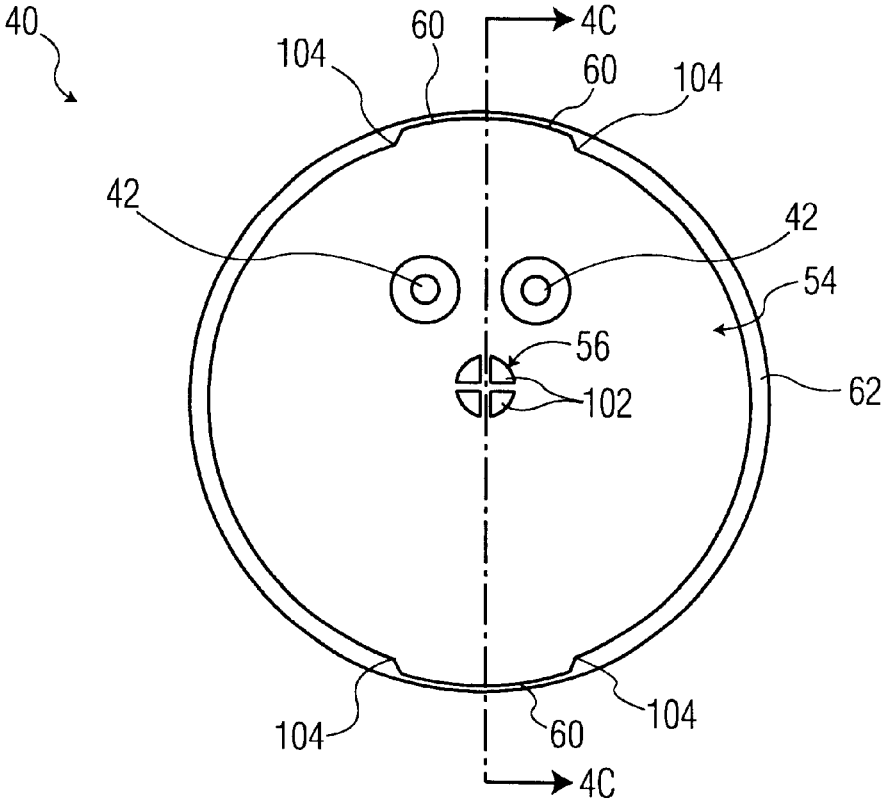
FIG. 4B is a top plan view of the mounting plate of FIG. 4A.
Figure 4C:
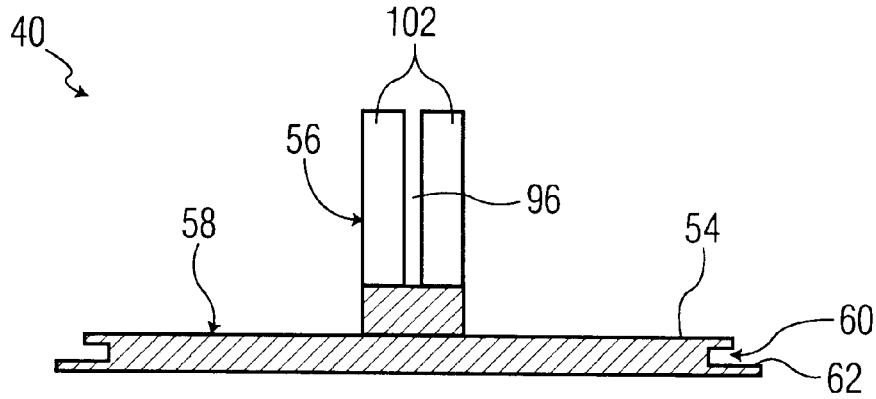
FIG. 4C is a cross sectional view of the mounting plate taken along line 4C—4C of FIG. 4B.

Referring to FIGS. 4A to 4C, the mounting plate 40 is shown in greater detail. The spindle body 56 is substantially cylindrical in shape, and includes a plurality of bosses 102 for defining a pair of perpendicular slots 96 therebetween. The slots 96 are configured to receive and retain therein the interior tang 92 of the coil spring 46. The mounting plate 40 includes a pair of ramp areas 104 each located proximate to the projected recesses 60. The ramp areas 104 facilitates sliding of the cap member tabs 98 over the raised portion of the projected recesses 60 for tight coupling engagement between the tabs 98 and the projected recesses 60. It is also noted that the screw holes 42 are countersunk for setting the heads of the screws flush with the bearing surface 4 of the mounting plate 40.

Figure 5A:
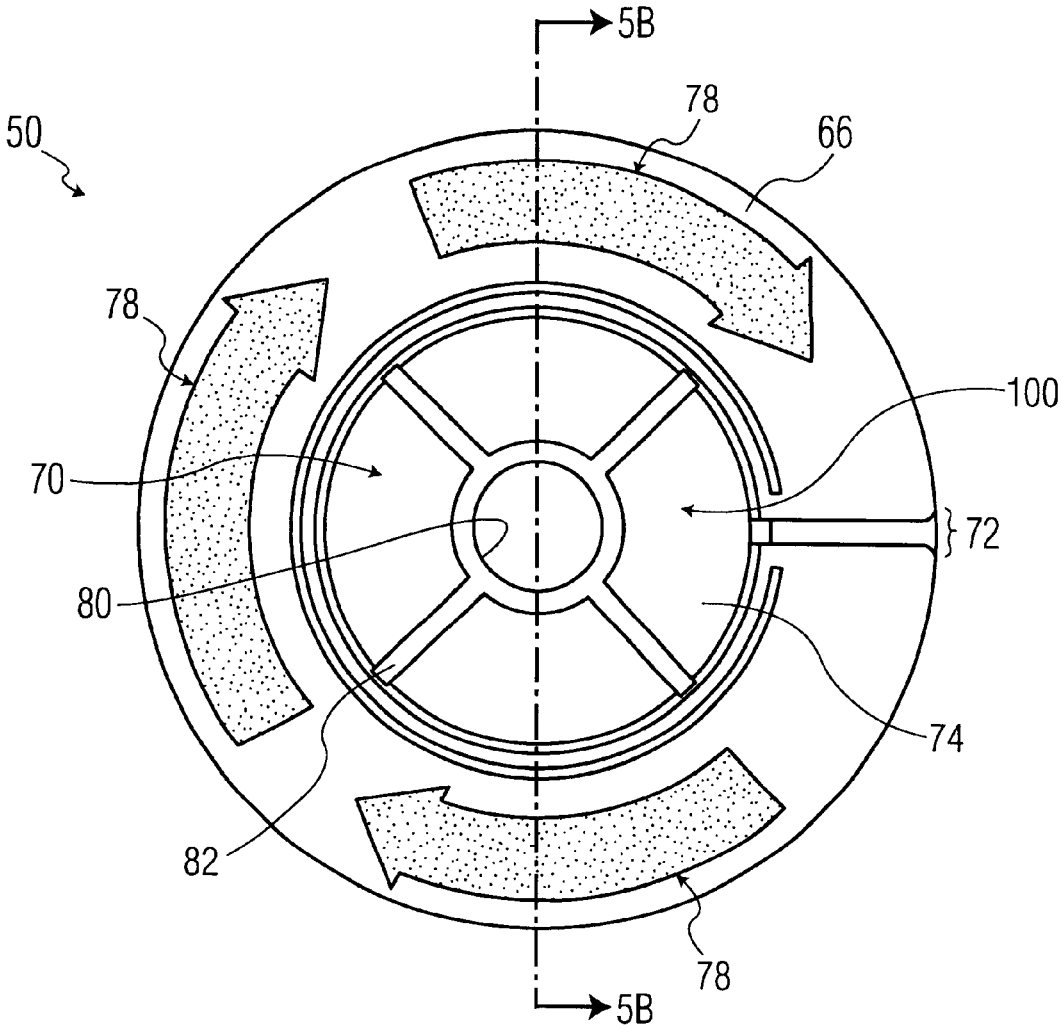
FIG. 5A is a top plan view of a spool forming part of the pull-cord keeper for one embodiment of the present invention.
Figure 5B:
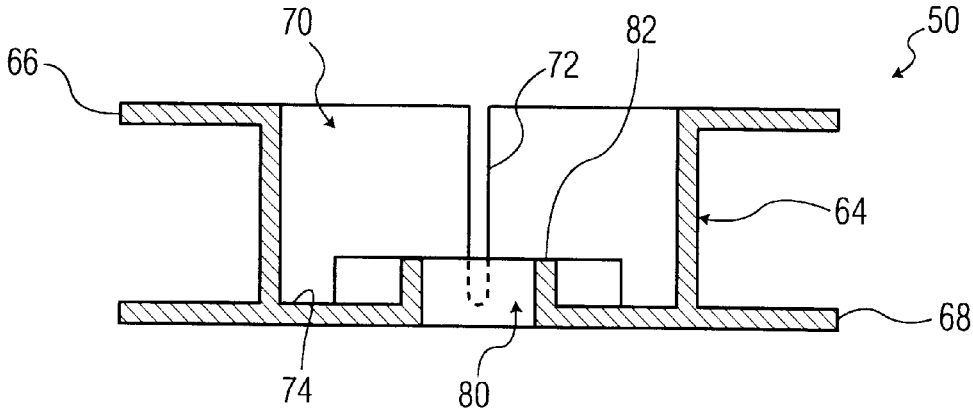
FIG. 5B is a cross sectional view of the spool taken along line 5B—5B of FIG. 5A.

Referring to FIGS. 5A and 5B, the spool member 50 is illustrated in greater detail. The top surface of the first flange 66 and the bottom surface of the second flange 68, each provide bearing surfaces that cooperate with the bearing surfaces 54 and 76 of the mounting plate 40 and the cap member 34, respectively, for sliding engagement therebetween. In addition, the edge portions of the flanges 66 and 68 also provide bearing surfaces corresponding with the interior circumferential surface of the cap member 34. Accordingly, the spool 50 can slidingly rotate in either direction within the housing 32 formed by the cap member 34 and the mounting plate 40. The slot 72 permits the knotted free end of the pull-cord 4 to be inserted into the hollow 100 of the base portion 74 and be captively retained therein by the spool slot 72 and the spring cartridge 48.

The frictional contact strips 78 provided on the top surface of the first flange 66, include irregular surface contours for improving frictional contact between the spool 50 and the user's finger. During installation prior to use, the user is required to wind the free end of the pull-cord 4 into the pull-cord keeper 30. The frictional contact strips 78 assist and improve the user's gripping contact with the spool 50, and facilitate the winding up of the pull-cord 4 prior to mounting the cap member 34 to the mounting plate 40. The frictional contact strips 78 may include other forms such as finger indentations, rubber projections, protuberances, adhesive patches, and the like for improving the gripping contact with the user's finger on the spool 50. In this embodiment, the frictional contact strips 78 are each rendered in the shape of an arrow for indicating to the user the rotational direction of the spool 50 for winding up the pull-cord 4 during installation as will be described.

Figure 6:
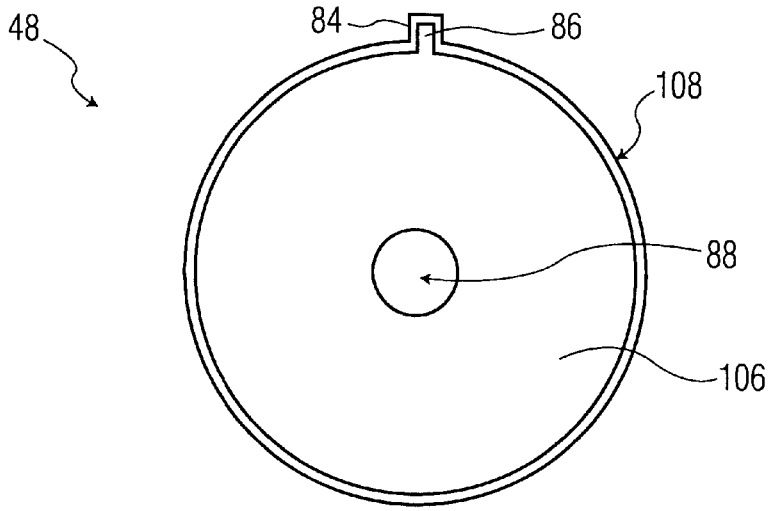
FIG. 6 is a top plan view of a spring cartridge forming part of the pull-cord keeper for one embodiment of the present invention.

Referring to FIG. 6, the spring cartridge 48 is shown in greater detail. The cartridge 48 comprises a circular base portion 106, and a sidewall 108 extending along the periphery thereof. The ridge 84 extends radially outward from the sidewall 108 for insertion into the spool slot 72 during assembly. The coil spring, as shown in FIG. 7, is placed into the cartridge 48 for facilitating assembly of the pull-cord keeper 30. The exterior tang 90 is placed into the notch 86 of the spring cartridge 48. The other end of the spring 48, or the internal tang 92 is slipped into the slot 96 of the spindle body 56 of the mounting plate 40 (see FIG. 4C) for providing an anchor point during loading of the spring 46.

Figure 8:
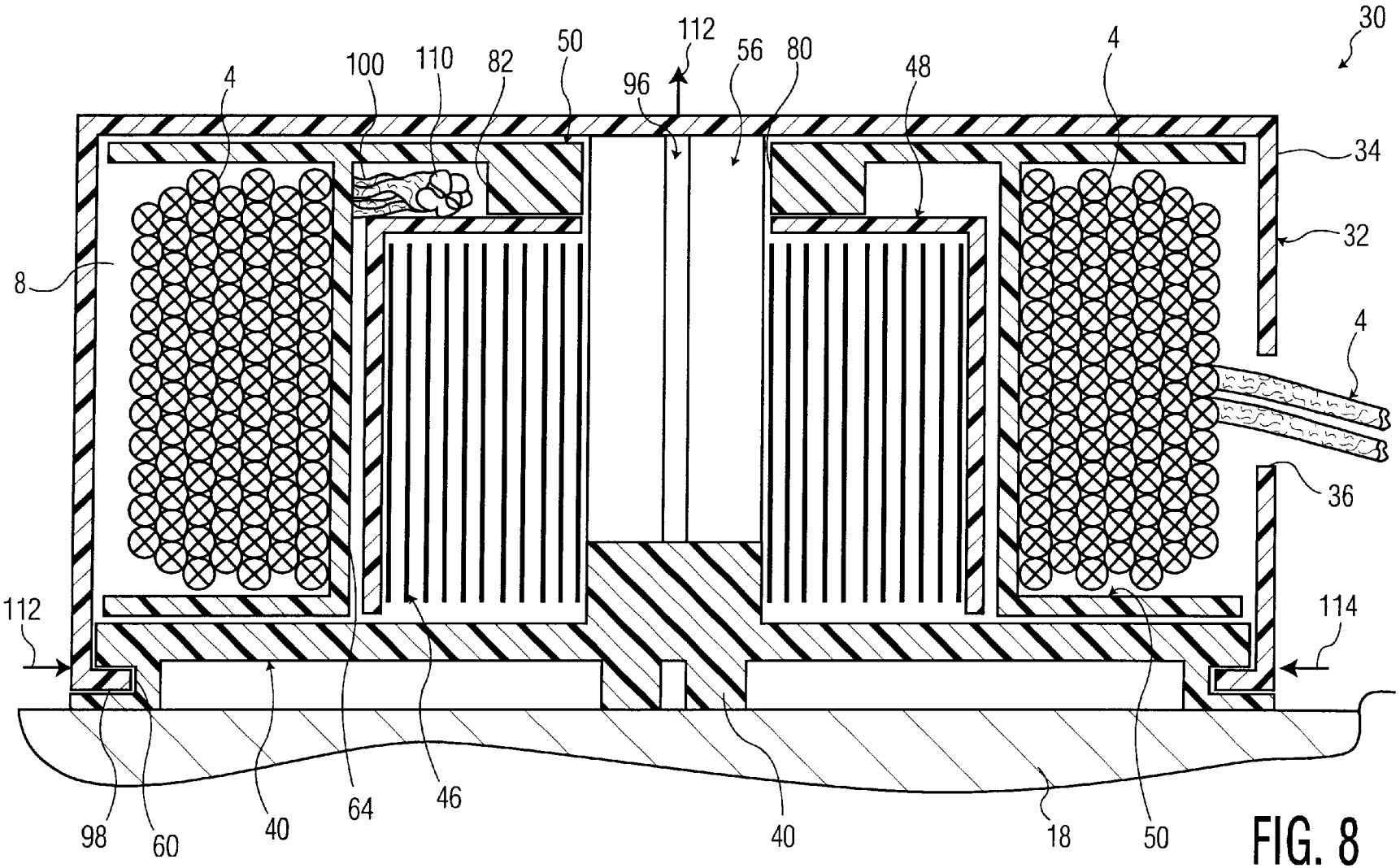
FIG. 8 is a cross sectional view of the pull-cord keeper for one embodiment of the present invention taken along line 8—8 of FIG. 1.

With reference to FIG. 8, the pull-cord keeper 30 is shown in cross section in the assembled form and mounted on a wall 18. The knotted free end 106 of the pull-cord 4 is held captive in the hollow 100, and extends radially away through the spool slot 72 (as shown in FIGS. 4A and 4B) and around the spool cylindrical body 64 prior to exiting the cap member opening 36. The spool 50 with the coiled pull-cord 4, the spring cartridge 48, and the exterior tang 90 are rotatable as a single unit within the interior cavity 38 of the housing 32 around the spindle body 56. During operation, the mounting plate 40, the interior tang 92 (as shown in FIG. 7), and the cap member 34 remains stationary. As the pull-cord 4 is being drawn from the spool 50, the coil spring 46 is wound up around the spindle body 56 into a spring loaded state. As the pull-cord 4 is released from the window treatment assembly 2 (i.e. window covering is raised), the spring loaded spool 50 is rotationally biased in the direction for winding up the relaxed length of the pull-cord 4 into the keeper 30.

During operation, the pull-cord keeper 30 is subject to substantial torque forces and stresses associated with repeated use. The locking interaction between the tabs 98 and the projected recesses 60 are further enhanced by the spindle body 56 biasing the central portion of the cap member 34 away from the mounting plate 40 as represented by arrow 112. This biasing effect causes the rim portion of the cap member 34 to press radially inward as represented by arrows 114. As a result, the tabs 98 are biased into the projected recesses 60 for a tighter, more secure fit. In order to remove the cap member 34, the cap member 34 must be rotated axially about the spindle body 56 to overcome the bias forces generated by the spindle body 56 on the cap member 34 to disengage the tabs 98 from the ramped projected recesses 60. Removal by pulling the cap member 34 away from the mounting plate 40 requires substantial force to be applied. This enhanced locking interaction substantially improves the overall durability and reliability of the pull-cord keeper 30.

With reference to FIGS. 1 to 8, the installation and operation procedures of the pull-cord keeper will now be described. A suitable point on the wall 18 proximate the upper portion of the window treatment assembly 2 is selected. The mounting plate 40 is fastened to the point on the wall 18 by the fastening screws 44 with the spindle body 56 extending away from the wall 18. The spool 50 is placed into the cap member 34 with the open end of the axial bore 70 oriented up. The pull-cord 4 of the window treatment assembly 2 is then drawn all the way out (i.e., raising the bottom rail 12 to the top of the window 5). The end of the pull-cord 4 is pulled through the opening 36 of the cap member 34. The free end of the pull-cord 4 of the window treatment assembly is knotted and placed into the axial bore 70. The pull-cord 4 is slipped into the spool slot 72. The coil spring 46 is placed into the spring cartridge 48 with the exterior tang 90 occupying the cartridge notch 86. The spring 46 and cartridge 48 are then placed into the axial bore 70 of the spool 50. The spool assembly is then rotated in a clockwise direction or the direction indicated by the arrows rendered by the frictional contact strips 78 to wind up the pull-cord 4. As the pull-cord 4 is wound up, the cap member 34 is transported up to the mounting plate 40 on the wall 18. The frictional contact strips 78 improves the user's gripping contact on the spool 50 during rotation. The interior tang 92 is slotted into the spindle body 56. The cap member 34 is oriented so that, upon locking, the opening 36 is directed towards the window treatment assembly 2. The cap member 34 is rotated on the mounting plate 40 into a locked position where the tabs 98 snap securely into the projected recesses 60.

For operation, the user simply manipulates the pull-cord 4 in the normal course of operating the window treatment assembly 2. The pull-cord keeper 30 automatically lets out or takes in the length of the pull-cord 4 as required to maintain a taut condition. No separate action on the part of the user is required for operating the pull-cord keeper 30. In this manner, the pull-cord 4 is always kept away from the reach of the infant or young child while permitting easy access to the adult user.

Although various embodiments of the invention have been shown and described, they are not meant to be limiting. Those of skill in the art may recognize various modifications to these embodiments, which modifications are meant to be covered by the spirit and scope of the appended claims.

What is claimed is:

1. A pull-cord keeper for a window treatment assembly, said window treatment assembly including for operation a pull-cord, said keeper comprising:

a housing configured for secure mounting attachment on a wall near an upper portion of the window treatment assembly, said housing further including:

a mounting plate configured for mounting attachment to the wall;

a cap member having a closed top and an open bottom, said cap member being adapted for attachment to one side of the mounting plate opposite the wall; and a cavity being defined therebetween; fastening means for securely mounting said mounting plate to the wall; an opening extending through said housing in communication with said cavity; a spool adapted for rotational movement within said cavity to reel and collect through said opening a length of said pull-cord;

a spring for biasing the spool in a rotational direction for reeling the length of the pull-cord during a constant spring-loaded state, for automatically and continuously collecting any loose length of said pull-cord;

the mounting plate further comprises a spindle extending centrally away therefrom, said spindle having a slot; and the spool further comprises:

a cylindrical hub portion with first and second flanges extending radially outward at top and bottom ends thereof, respectively, said hub being hollow for defining a centrally located cavity open at said top end, said bottom end of said hub partially closing off said cavity with a centrally located hole therethrough, said hole being surrounded by a ring shaped bushing extending partially into said cavity, said bushing being adapted for rotatably receiving an end portion of said spindle whereby said spool is rotatably disposed about said spindle; and a slot radially extending through said first flange and hub, said slot terminating at said second flange, said slot being adapted for receiving and retaining a free end of the pull-cord.

2. The pull-cord keeper of claim 1, wherein the cap member is cylindrical in shape.

3. The pull-cord keeper of claim 2, wherein the opening extends circumferentially along a side portion of said cap member.

4. The pull-cord keeper of claim 1, further comprising a cylindrical spring cartridge, said cartridge including a circular base portion with a sidewall portion extending upwardly along the periphery of said base portion, a centrally-located hole in said base portion for passing the spindle therethrough, an open top portion, a recess notch in an interior side of the sidewall portion, and a tab on an exterior side of the sidewall portion, said cap member being configured for seating within the cavity of said hub of said spool with the cartridge tab fitting snugly in the spool slot.

5. The pull-cord keeper of claim 4, wherein:

the spring comprises a coil spring having an exterior tang and an interior tang; and said spring cartridge being adapted for retaining the coil spring with the exterior tang inserted into the recess notch, and the interior tang inserted into the slot of the spindle.

6. The pull-cord keeper of claim 1, wherein a free end of said spindle body biases against a central interior top surface of said cap member for causing a rim portion about the bottom of said cap member to bias inwardly against an edge portion of said mounting plate.

7. The pull-cord keeper of claim 1, wherein the housing and the spool each consist of a plastic material.

8. The pull-cord keeper of claim 5, wherein the coil spring consists of a metal material.

9. A pull-cord keeper for a window treatment assembly, said window treatment assembly including for operation a pull-cord said keeper comprising:

a housing configured for secure mounting attachment on a wall near an upper portion of the window treatment assembly, said housing further including:

a mounting plate configured for mounting attachment to the wall;

a cap member having a closed top and an open bottom, said cap member being adapted for attachment to one side of the mounting plate opposite the wall; and a cavity being defined therebetween;

said mounting plate further including a pair of opposing ramped projecting recesses formed along an edge portion of the mounting plate;

said cap member further including a pair of opposing ramped tabs located along an inside rim portion of said cap member corresponding with said ramped projecting recesses, said ramped tabs being configured for snuggly fitting within the ramped projecting recesses, when the cap member is rotated on the mounting plate to a locking position where the tabs align radially with the corresponding recesses and mate therewith an opening extending through said housing in communication with said cavity;

a spool adapted for rotational movement within said cavity to reel and collect through said opening a length of said pull-cord; and a spring for biasing the spool in a rotational direction for reeling the length of the pull-cord during a constant spring-loaded state, for automatically and continuously collecting any loose length of said pull-cord.

10. A pull-cord keeper for a window treatment assembly, said window treatment assembly including for operation a pull-cord, said keeper comprising:

a housing configured for secure mounting attachment on a wall near an upper portion of the window treatment assembly, said housing further including:

a mounting plate configured for mounting attachment to the wall;

a cap member having a closed top and an open bottom, said cap member being adapted for attachment to one side of the mounting plate opposite the wall; and a cavity being defined therebetween;

fastening means for securely mounting said mounting plate to the wall;

an opening extending through said housing in communication with said cavity;

a spool adapted for rotational movement within said cavity to reel and collect through said opening a length of said pull-cord;

a spring for biasing the spool in a rotational direction for reeling the length of the pull-cord during a constant spring-loaded state, for automatically and continuously collecting any loose length of said pull-cord;

said mounting plate further includes a pair of opposing ramped projecting recesses formed along an edge portion of the mounting plate; and said cap member further includes a pair of opposing ramped tabs located along an inside rim portion of said cap member corresponding with said ramped projecting recesses, said ramped tabs being configured for snuggly fitting within the ramped projecting recesses, when the cap member is rotated on the mounting plate to a locking position where the tabs align radially with the corresponding recesses and mate therewith.

* * * * *